United States Patent [19]

Knorring

[11] 4,175,415

[45] Nov. 27, 1979

[54] FINISHING TOOL

[75] Inventor: Richard T. Knorring, Worcester, Mass.

[73] Assignee: Cincinnati Milacron-Heald Corporation, Worcester, Mass.

[21] Appl. No.: 934,904

[22] Filed: Aug. 18, 1978

[51] Int. Cl.[2] ..... B21H 1/00

[52] U.S. Cl. ..... 72/101; 72/111; 51/5 A; 409/155; 409/167

[58] Field of Search ..... 51/5 R, 5 A, 5 F; 90/24 A, 24 C, 24 F; 72/70, 72, 101, 80, 110, 111, 67, 91, 246; 29/565

[56] References Cited

U.S. PATENT DOCUMENTS

| | | | |
|---|---|---|---|
| 760,926 | 5/1904 | Schroeder | 51/5 R |
| 852,829 | 5/1907 | Einfeldt | 72/111 |
| 1,518,283 | 12/1924 | Theberath | 72/72 |
| 1,772,500 | 8/1930 | Schumacher | 72/101 |
| 2,889,721 | 6/1959 | Coleman | 90/24 A |
| 3,453,850 | 7/1969 | Zeller et al. | 72/80 |
| 3,850,017 | 11/1974 | Fencl et al. | 72/70 |

*Primary Examiner*—Lowell A. Larson
*Attorney, Agent, or Firm*—James D. Liles

[57] ABSTRACT

A tool for deburring or finishing a workpiece is mounted for common reciprocatory movement with the wheelhead of a grinding machine. The tool, which is form of an elongated rod, is supported in a housing which is in turn pivoted about an axis transverse to the tool. A biasing means urges the tool toward a predetermined angular position about the pivotal axis of a housing. The tool cooperates with a workpiece to selectively overcome the bias and oscillate the tool in accordance with the relative reciprocatory movement between the grinding wheel and the workpiece.

10 Claims, 4 Drawing Figures

FINISHING TOOL

BACKGROUND OF THE INVENTION

This invention relates generally to metalworking and more particularly concerns a method and apparatus for finishing a machined workpiece. The invention will be specifically disclosed by way of example, in connection with a deburring or finishing tool used upon a machine tool especially adopted for removing burrs or sharp edges from the interface of two surfaces of a piston ring.

The machining of metals often leaves sharp corners, thin ridges of workpiece material or residual areas of roughness when a metalforming element is removed. Sharp edges are formed whenever two surfaces are machined to abruptly intersect. The thin edges of material and surface irregularities are commonly referred to as burrs.

Burrs may be formed in a variety of ways during a machining process. In general, they are formed whenever workpiece material is permitted to flow unrestrained toward an edge of the metalforming element. They may be produced, inter alia, when a metalforming element enters a workpiece (entrance burrs), when the metalforming element exits the workpiece (roll-over burr), at the edges of the cut (poisson burr) or when a chip is pulled rather than sheared from a workpiece (tear burr).

Whatever the source of burrs or sharp corners, it is imperative that they be removed from many workpieces. The prior art has witnessed a wide variety of deburring techniques. Many of the prior art deburring techniques are multi-step. They require a secondary production step in addition to the primary metalforming process. The expense and time delays precipitated by these multi-step processes make them undesirable from a production viewpoint.

One such commonly employed process involves manually engaging a workpiece with a rotary powered brush after machining. This process, in addition to requiring additional time, is also very frequently ineffective in removing sharp corners.

Another commonly employed technique involves placing a plurality of workpieces into an agitating barrel with abrasive materials. The barrel finishing technique, in addition to being a time consuming second step, is inherently non-selective and may take off critical portions of the workpiece and effect tolerances. Barrel finishing is also generally ineffective in removing burrs from recessed areas.

Abrasive jet blasting is a process in which a compressed air jet stream filled with particulate abrasive matter is directed against a surface. This technique is much more selective than barrel finishing but is unsatisfactory for hard to remove burrs or corners.

Various other deburring techniques have been used in the past, as for example, electro-chemical and thermal deburring. However, like the previously mentioned techniques, they are replete with disadvantages. For example, electro-chemical deburring is expensive and inflexible due to the special tooling required for each different sized workpiece; and thermal deburring may result in damage to the workpiece. Additionally, these techniques, like each of the other aforementioned ones, do not afford the luxury of simultaneously deburring the workpiece with the primary metal forming process.

Mechanical deburring tools do have the potential for simultaneous operation. Still, most prior art mechanical deburring tools have awkward and cumbersome physical structures, a disadvantage which is accentuated when operating upon hard to reach internal surfaces. Further, it has been found that, when using a finishing tool, workpiece material may tend to flow toward the edges of the cut if relative movement between the workpiece and the tool is constant and in a single direction. Thus, many of these tools, when being used to remove a single burr (or ridge) may themselves form a pair of similar, albeit smaller, burrs upon the edge of the workpiece interface. Similarly, a finishing tool which is planar is likely to form smaller burrs at an abrupt edge of the planar surface.

SUMMARY OF THE INVENTION

According to the invention, a finishing tool assembly for use with a machine tool has a housing which is pivotally mounted upon a base. An elongated rod is supported in the housing and extends outwardly in a direction transverse to the pivotal axis of the housing. Means are provided for oscillating the housing element about its pivotal axis and moving the rod in an arcuate path about the housing axis while the rod engages a workpiece about its periphery.

In the preferred embodiment, the housing is mounted for common reciprocatory movement with the metalforming element of a machine tool. A biasing means is associated with the housing tending to rotate the housing to a predetermined angular position about the pivotal axis of the housing. A rod extends transverse to the housing axis to contact a workpiece and cooperates with the workpiece to selectively overcome the biasing means in accordance to the reciprocatory movement of the metalforming element.

BRIEF DESCRIPTION OF THE DRAWINGS

There will now be given a detailed description to be read with reference to the accompanying drawings of an apparatus which is preferred embodiment of the invention and which has been selected to illustrate this invention by way of example.

In the accompanying drawings.

DETAILED DESCRIPTION OF THE PREFERRED EMBODIMENT

Figure 1:
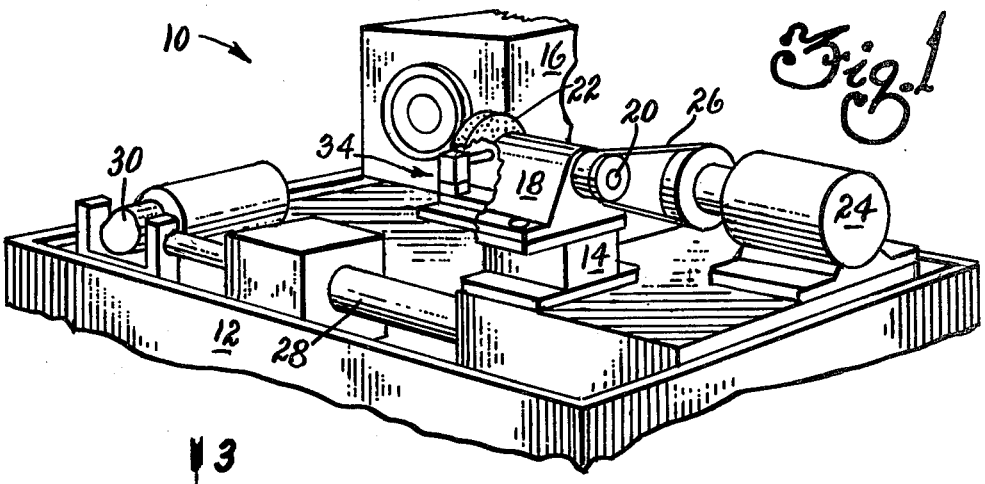
FIG. 1 is a perspective view of a grinding machine utilizing a form of the present invention, with details omitted for clarity of illustration.

Turning first to FIG. 1, a grinding machine 10 is shown having a base 12 upon which a wheelhead 14 and workhead 16 are mounted. The wheelhead 14 contains a spindle housing 18 rotatably supporting a spindle 20. A grinding wheel 22 is supported upon one end of the spindle 20, and belt 26 is engaged with the other end of the spindle, opposite the spindle housing 18, to transmit rotary power generated by a motor 24. The wheelhead 14 is rigidly attached to a pivot bar 28, which is rotatably and longitudinally moved by actuators (not shown)

to provide feed movment between the wheelhead 14 and workhead 16. An oscillator 30 provides supplemental oscillatory longitudinal movement of the pivot bar 28 and serves to eliminate feed lines upon a workpiece. The grinding machine described thus far is of a construction antedating the present invention and is of the general type disclosed in U.S. Pat. No. 4,096,667.

Figure 2:
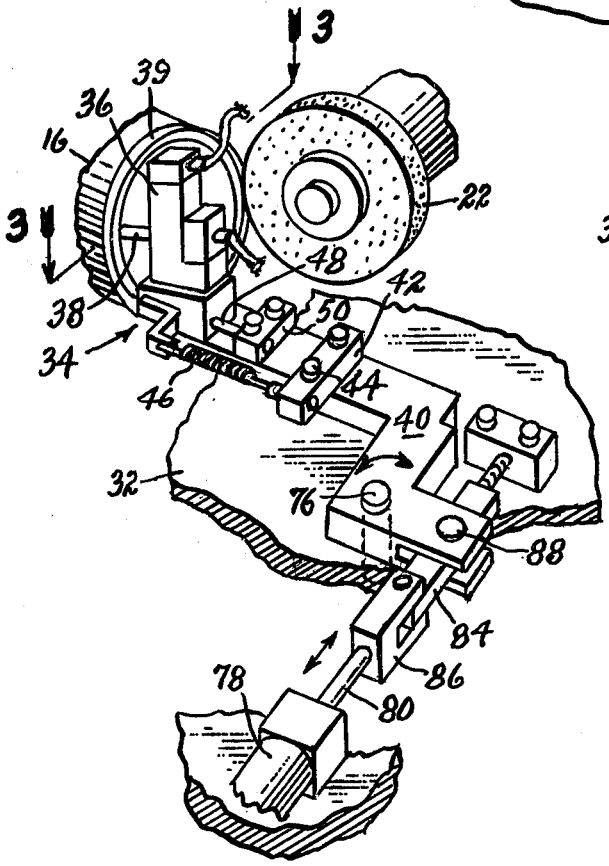
FIG. 2 is a fragmentary perspective view depicting the finishing tool assembly on the grinding machine illustrated in FIG. 1 in greater detail.

In the preferred embodiment of the invention, the general features of which are shown most clearly in FIG. 2, a support plate 32 extends from the wheelhead 14 to support a finishing tool assembly 34. The assembly 34 includes a tool housing 36 supporting an elongated hardened metal rod 38 used to finish a workpiece 39. The housing 36 is supported upon a carrier arm 40 which is in turn supported upon the support plate 32.

The rod 38 has an elongated cylindrical configuration with a substantially circular cross section which provides several advantages. The circular cross section configuration is symmetrical about the rod's longitudinal axis and therefor may be rotated about the axis without altering the distance from the housing to the contact area interface with the workpieces. It also provides a taper about the edges of the workpiece contact area and eliminates an abrupt edge of the contact surface. Further, this configuration assists in positioning the tool at a specific workpiece location, particularly when it is desired to finish an internal workpiece surface. The circular cross section of the rod 38 also presents a convex interface surface for contact with the workpiece, resulting in relatively high Hertzian stresses which assist in workpiece breakdown and burr removal. The Hertzian stresses are particularly pronounced when the rod's radius of curvature is small.

Figure 4:
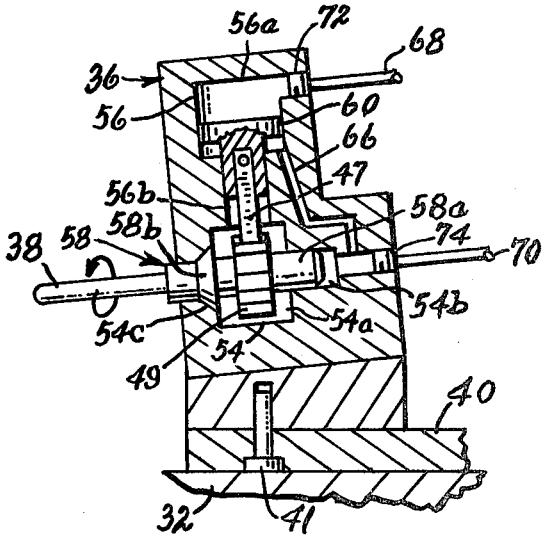
FIG. 4 is a cross-sectional side elevational view of the finishing tool assembly of FIGS. 1 through 3 with details omitted for clarity of illustration.

As most readily realized with a joint viewing of FIGS. 2 and 4, the housing 36 is pivotally mounted upon a carrier arm 40 about a pin 41 (FIG. 4). A cross bar 42 secured by screws 44, transverses the arm 40 in the vicinity of the housing 36. The cross bar 42 serves to support one end of an extension spring 46 whose opposite end is connected to the tool housing 36. The spring 46 tends to rotatably bias the housing about its pivot at pin 41 so as to engage an edge of the workpiece 39 with the periphery of the elongated metal rod 38. Thus, rotational movement of the housing is terminated whenever the rod 38 engages the workpiece or the housing contacts a stop 48 mounted in a cross bar 50 rigidly disposed upon the carrier arm 40 between the housing 36 and cross bar 42. As the support plate is oscillated parallel to the longitudinal axis of the pivot bar 28, under the influence of the oscillator 30, the bias of spring 46 is overcome and relaxed with each cycle of oscillatory motion. The finishing tool is thus oscillated without the necessity of an auxiliary power source. The spring 46 tends to return the housing 36 towards the stop and into constant engagement with workpiece 39 throughout the oscillatory movement. The interface force between the elongated rod 38 and the workpiece 39 may, of course, be varied by substituting springs (46) with different spring rates.

As most clearly depicted in FIG. 4, the elongaged rod 38 is also rotatable about its longitudinal axis simultaneously with the arcuate movement of pin 41. In the illustrated form, this longitudinal rotation of the rod 38 is achieved by a pawl 47 and ratchet 49 mechanism within the housing 36. The housing 36 has two internal perpendicular bores 54 and 56 of circular cross section, the bore 54 running substantially horizontal and the bore 56 running substantially perpendicular. Each of the bores has a portion of enlarged diameter (**54*a*, 56*a*) as well as a portion of reduced diameter (54*b*, 56*b*) with the reduced portion of bore 56 communicating with enlarged portion of bore 54**.

An actuator 58 is disposed within bore 54 and has a portion of reduced diameter **58*a* upon one end which fits within the reduced portion 54*b* of horizontal bore 54. The actuator 58 has a conical surface 58*b* upon the other end and which is mated against a conical surface 54*c* of bore 54. A piston 60 is axially movable within the enlarged vertical bore 56*a* and moves the pawl 47 within the bore 56*b* and into bore 54 where it engages a ratchet 49 about the periphery of actuator 58. A fluid passage 66 provides fluid communication between the bottom of enlarged bore 56*a*, beneath the piston 60 and reduced portion 54*b*. Hydraulic fluid lines 68 and 70 are connected to a fluid source (not shown) to selectively communicate pressurized fluid to ports 72 and 74 communicating with bores 56*a* and 54*b*** respectively.

In operation, as pressurized fluid is introduced into hydraulic line 70, a compressive force is exerted against the end portion of actuator **58*a* urging it leftwardly as viewed in FIG. 4. The movement of actuator 58 forces the conical surface 58*b* into a tight frictional engagement against mating conical surface 54*c* of the bore 54, preventing rotation of the actuator 58. Fluid pressure within the bore 54*b* is also communicated through a fluid passage 66 to the underside of piston 60 in the bore 56*a*, urging the piston 60 and the pawl 47, which it carries, upwardly. Fluid in bore 56*a* above piston 60 is exhausted out bore 72 and conduit 68. When, through suitable valving (not shown) the pressurized fluid is diverted into conduit 68 and port 72, and fluid is exhausted from port 74 and conduit 70, piston 60 is urged outwardly. Pawl 47 engages ratchet 49 on a periphery of actuator 58 forcing rotation of the actuator and rod 38**.

It should also be apparent that the rod 38 might also have any of several well-known mechanisms for imparting longitudinal axial movement.

Turning once again to FIG. 2, it can be seen that the carrier arm 40 is selectively pivoted about pin 76 (which is parallel but noncoincident to the housing pivot pin 41) according to the dictates of a piston which is reciprocably housed within a cylinder 78. A rod 80 extends from the piston and moves a link 84 connected to the piston rod 80 by a clevis joint 86. A pin 88 extending parallel to pins 76 and 41 (FIG. 4) intersects both the link 84 and carrier arm 40 to insure pivoting of the carrier arm 40 about pin 76 with linear movement of the piston contained within cylinder 78.

Figure 3:
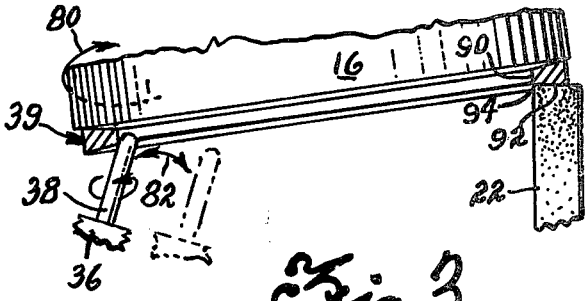
FIG. 3 is a plan view of an end portion of the finishing tool assembly of FIG. 2 illustrating its relationship to a specific workpiece.

FIG. 3 illustrates the elongated rod 38 (in the solid line depiction) in engagement with the interior interface (corner) 94 of two substantially planar surfaces 90 and 92 of the workpiece 39 shown as a trapezoidal (keystone) piston ring whose face is being ground by the grinding wheel 22. As illustrated in the drawing by the arrow 80, the workpiece 39 is being rotated by the workhead 16 in a clockwise direction. The rod 38 as illustrated by arrow 82 is simultaneously being rotated about pivot pin 41 (FIG. 4) of a housing assembly 34 (due to the reciprocation of wheelhead 14) and about the longitudinal axis of rod 38 (by the pawl 47 and rachet 49). The conjugate movement between the workpiece 39 and rod 38 breaks the corner of the interface 94 between the substantially planar surfaces 90 and 92 and removes any burrs at this location. The phantom position of the housing assembly 34 in FIG. 3 shows the rod 38 and housing 36 in a retracted position out of engagement with the workpiece 39. This retracted position illustrated in phantom might be employed during rough or nonfinishing grinding modes of the grinding machine 10 and is obtained by pivoting the carrier arm 40 about pivot pin 76.

Although the invention has been illustrated in some detail according to the preferred embodiment shown in the accompanying drawings, and while the preferred illustration and embodiment has been described in some detail, there is no intention to limit the invention to such details. On the contrary, it is intended to cover all modifications, alternations and equivalents falling within the spirit and scope of the appended claims.

I claim:

1. A finishing tool assembly for finishing a workpiece, comprising:

(a) a base;

(b) a housing pivotally mounted upon the base about an axis;

(c) a finishing tool, said tool being in the form of an elongated rod with a substantially circular cross-section extending from said housing in a direction transverse to the axis of the housing pivot and having a workpiece interface on its periphery;

(d) means for effectuating relative movement between said housing and a workpiece; and (e) means for oscillating said housing about its pivotal axis in coordination with said effectuating means.

2. A finishing tool assembly as recited in claim 1 wherein said oscillatory means includes means for biasing said housing about its axis and means for selectively overcoming said bias.

3. A finishing tool assembly as recited in claim 1 wherein said elongated rod is rotatable about its longitudinal axis.

4. A finishing tool assembly as recited in claim 3 further including means for positively driving said elongated rod about its longitudinal axis.

5. A tool as recited in claim 2 wherein the base is pivotally mounted about a noncoincident axis parallel to said housing axis.

6. A tool as recited in claim 4 further including means for selectively moving said housing about said parallel axis.

7. In a machine tool having a workpiece support and a metalforming element reciprocably movable with respect to each other, a finishing tool comprising:

(a) a tool housing mounted with said metal forming element for common reciprocatory movement therewith, said housing being pivotally movable about an axis transverse to said reciprocatory movement;

(b) biasing means associated with said housing for biasing said housing toward a predetermined angular position about its axis; and (c) an elongated rod extending from said housing in a direction transverse to said housing axis for contacting a workpiece, said rod being adapted to cooperate with a workpiece to overcome said biasing means and pivotally move said housing about its axis in accordance to the relative reciprocatory movement between said workpiece support and said metal forming element.

8. A tool as recited in claim 6 wherein said housing and rod are pivotally movable about a second axis for removing the rod from the workpiece, said second axis being noncoincident and parallel to said housing axis.

9. A tool as recited in claim 7 further including means for selectively moving said housing about said second axis.

10. A tool as recited in claim 6 further comprising means to rotate said elongated rod about its longitudinal axis.

* * * * *